United States Patent [19]

Deboute

[11] 4,152,066

[45] May 1, 1979

[54] APPARATUS FOR PROCESSING COLOR PRINTS

[76] Inventor: Valentin Deboute, Sainte Radegonde des Noyers, 85450 Chaille les Marais, France

[21] Appl. No.: 843,147

[22] Filed: Oct. 17, 1977

[30] Foreign Application Priority Data

Feb. 23, 1977 [FR] France ..... 77 06009

[51] Int. Cl.[2] ..... G03D 3/08

[52] U.S. Cl. ..... 354/299; 354/312; 354/319; 354/330

[58] Field of Search ..... 354/307, 310, 311, 312, 354/315, 316, 319, 320, 322, 328, 329, 330, 331, 337, 340

[56] References Cited

U.S. PATENT DOCUMENTS

| | | | |
|---|---|---|---|
| 2,947,236 | 8/1960 | Siegel | 354/307 |
| 3,359,880 | 12/1967 | Huss | 354/316 |
| 3,705,544 | 12/1972 | Ratowsky | 354/329 |
| 3,724,353 | 4/1973 | Holbert | 354/328 |
| 3,840,214 | 10/1974 | Merz | 354/330 X |
| 3,982,259 | 9/1976 | Baerle | 354/329 |
| 4,011,573 | 3/1977 | Braico | 354/329 |

*Primary Examiner*—L. T. Hix
*Assistant Examiner*—Alan Mathews

[57] ABSTRACT

Simple and economical apparatus for processing color photographic prints in broad daylight, which comprises a casing on which a light-tight cover is hingedly mounted; an inner tray formed with apertures in which juxtaposed processing tanks are adapted to be force fitted, and a central trough; a drum adapted to receive the print to be processed is mounted on the output shaft of a small motor and reduction gear unit and a shaft operable from outside the casing and controlling the motor and drum assembly so as to cause said assembly to perform axial and rotary movements as necessary for bringing said drum above said tanks successively and dipping said drum into the selected tank.

4 Claims, 3 Drawing Figures

APPARATUS FOR PROCESSING COLOR PRINTS

BACKGROUND OF THE INVENTION

The present invention relates to a particularly simple and economical apparatus for processing color photographic prints.

Many machines have already been proposed for processing color photographic prints but all of them require a high degree of professional experience, the use of many tanks consuming large amounts of developers, a considerable handling of products and in addition they can only be operated in a perfectly dark room.

SUMMARY OF THE INVENTION

The apparatus according to the instant invention is characterized essentially in that it can be operated continuously in broad daylight or under normal lighting conditions.

This apparatus is further characterized in that it comprises a light-tight casing in which a plurality of detachable tanks for the baths necessary for processing the prints are arranged in side-by-side relationship on a tray aperture accordingly, the bottom of the casing being filled with heated water in order to provide a constant processing temperature adjustable in the tanks, and means for controlling from the outside a print supporting member so that the latter can be brought to successive positions in which it registers with, and can be immersed into, each tank, respectively without opening the casing.

These control means may consist of a shaft adapted to slide freely in a bearing provided in the median transverse plane of the casing and to be actuated from outside the casing in order to bring the device supporting the print being processed in proper registration with the successive tanks and dip the print into each selected tank.

This shaft may be actuated for instance by means of an external handle solid therewith and enabling the print support to be moved both laterally and longitudinally; if desired, a programmed electric motor may be operatively connected to the shaft.

The print support may consist of an apertured drum provided with means for properly positioning the print therein and rotatably driven by an electric motor energized either from batteries or from the mains.

This drum may be secured to the output shaft of the driving motor and the latter may be secured in an easily detachably manner to the projecting external portion of the shaft.

According to a specific feature characterizing this invention, each tank of semi-cylindrical configuration is force fitted through apertures formed in the supporting tray housed in the bottom of the casing; the tanks are held in position by causing a transverse rib formed in one end face of each tank to bear against the correspondingly notched edge of the tray, the opposite end face of the tank being retained in position by a resilient element abuting the opposite edge of the casing.

The number of the tanks may vary as a function of the specific arrangement contemplated, for example the tanks may be disposed by pairs and side by side, in semi-cylindrical apertures or cavities of the tray, the pairs being separated from each other by a semi-cylindrical central trough.

A thermostat is provided for controlling the temperature of the bath filling the bottom of the casing.

A fluid- and light-tight top cover is provided for closing the casing while leaving enough room for not interfering with the movements of the print support from one processing tank to another. Preferably, this cover is hingedly mounted on the casing.

This apparatus may be operated under any desired lighting conditions, since the processing of the print in successive baths, namely the developing bath, the bleaching bath, the washing bath and the fixation bath, takes place within the light-tight casing at a constant controlled temperature and by actuating the print supporting shaft either manually or by means of a programmed motor.

A typical form of embodiment of a color print processing apparatus according to the teachings of the present invention will now be described more in detail with reference to the attached drawing, in which:

DESCRIPTION OF THE PREFERRED EMBODIMENT

Figure 1:
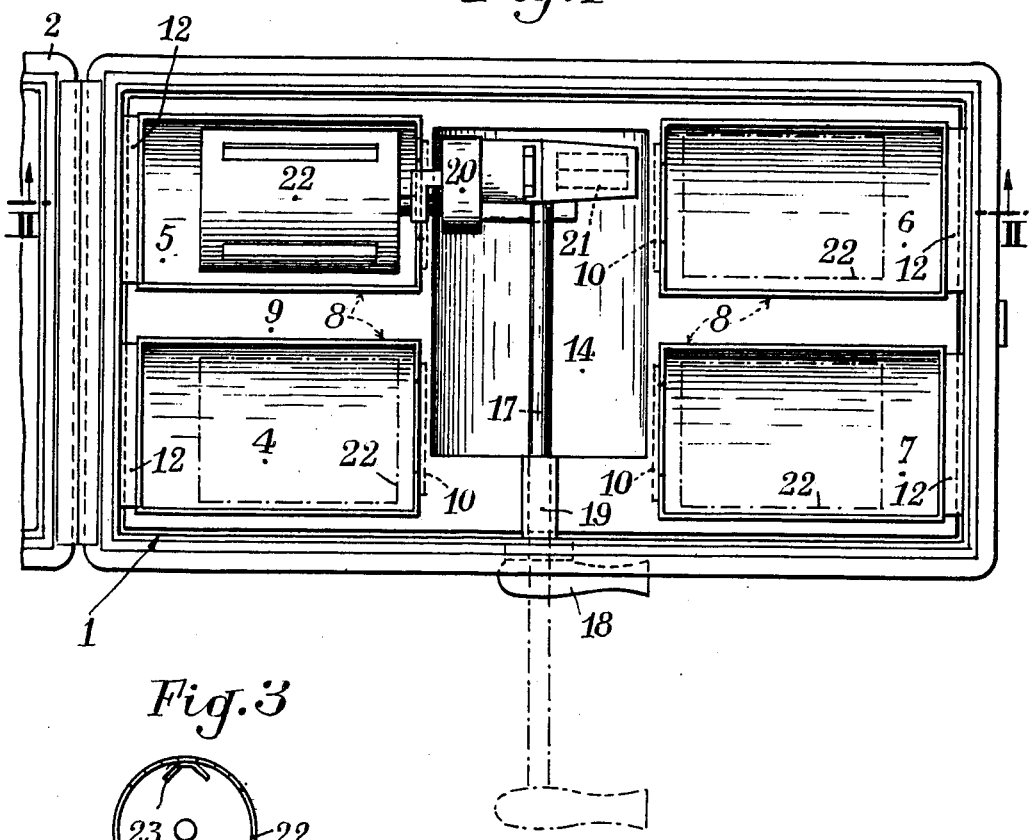
FIG. 1 is a plane view from above of the apparatus, the cover being removed to show the relative arrangement of the component elements therein.
Figure 3:
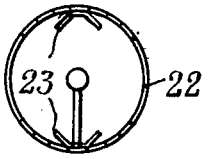
FIG. 3 is an end view of the print support.

The apparatus illustrated in the drawing comprises a relatively large parallelipipedic casing 1 provided with a bulged cover 2 hingedly mounted thereon and of which the flanged edges 3 engage in a fluid- and light-tight manner registering and matching flanged edges of the casing 1, preferably with the interposition of a gasket. The casing has detachably fitted therein four processing tanks 4, 5, 6 and 7 disposed by pairs side by side.

For this purpose each tank has a semi-cylindrical configuration and is adapted to be force fitted in apertures 8 formed in a tray 9. The tray 9 preferably molded as a unitary structure is somewhat spaced from the bottom of the casing. Each tank 4–7 has formed at one longitudinal end a projecting horizontal rib 10 adapted to engage the lower surface of the adjacent edge 11 of the corresponding aperture in tray 9, and at the opposite longitudinal end a resilient tongue 12 bearing against the inner surface of the vertical wall of casing 1 and also against the top of tray 9. the tray 9 further comprises in its central area an integral semi-cylindrical trough 14.

In operation, the casing 1 is filled with water up to the bottom of tanks 4, 5, 6 and 7 under the central trough 14, and this water is heated and kept at a suitable constant temperature for example by means of a dipper-type heating element 15 responsive to a control thermostat 16.

The first tank 4 contains the developer, and second tank the beaching agent, the third tank 6 the wash water and the fourth tank 7 the fixing agent.

To bring the print to be processed into each tank successively without opening the cover 2, the apparatus is provided with a central horizontal shaft 17 rigidly connected, or formed integrally with, a handle 18, this shaft being journalled in a bearing 19 secured centrally of the front wall of casing 1.

This shaft 17 carries a small motor and reduction gear unit 20 energized either from a battery or from the mains, the output shaft of the motor of this unit having an apertured drum 22 detachably secured thereto, so that the drum 22 can be rotatably driven from the motor through the reduction gearing at a relatively low speed.

The drum 22 consisting preferably of molded plastic of adequate composition is provided with internal guide members 23 for retaining the photographic prints therein during the processing thereof.

Thus, the handle 18 rigid with shaft 17 can be either moved for axial translation in order to being the drum 22 in proper registration with each pair of tanks, or rotated in the clockwise or counter-clockwise direction for dipping the drum into the selected left-hand or right-hand processing tank.

The above-described apparatus operates as follows:

The print is secured within the drum 22, then the motor 20 is started and the cover 2 is closed.

The operator rotates the handle 18 counter-clockwise until the drum 22 is dipped into the developer tank 4 (position shown is phantom lines in FIG. 1).

Figure 2:
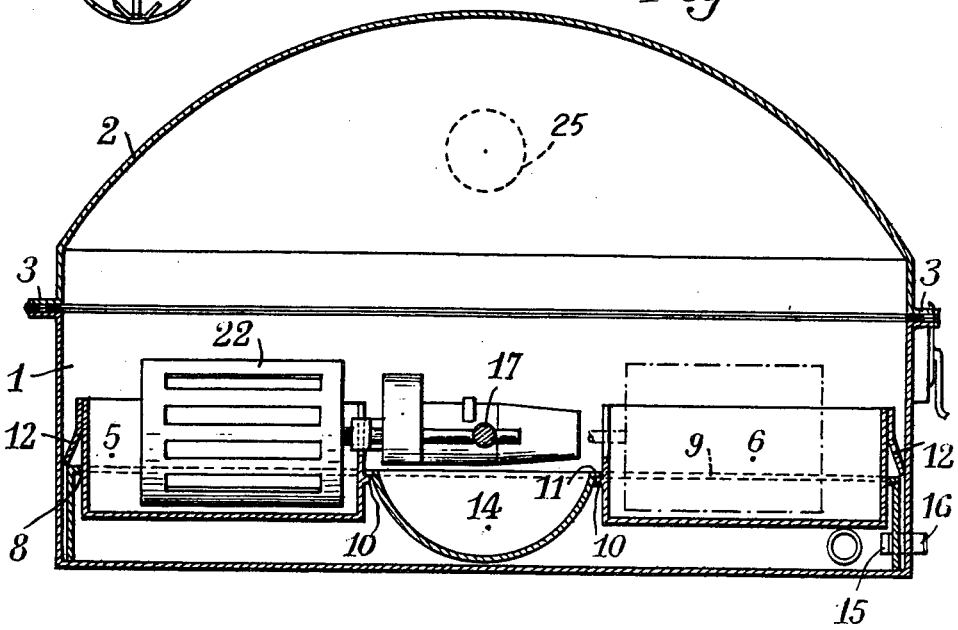
FIG. 2 is a longitudinal section taken along the line II—II of FIG. 1.

When the time period necessary for accomplishing this step of the process has elapsed as indicated for example by a programmer such as a time-switch 25 indicated in FIG. 2, the handle 18 is rotated somewhat in the clockwise direction to raise the drum, the print is allowed to drain out, this handle 18 is pushed forwards to position the drum 22 above the adjacent tank 5 containing the bleaching agent; then, the handle is rotated again counter-clockwise and the drum 22 is dipped into the bleaching agent (this position being shown in thick lines in FIGS. 1 and 2). When the predetermined time period has elapsed, the operator rotates the handle 18 clockwise to raise the drum 22 out of tank 5 and permit the draining of the excess product from the print, and the drum is moved back and dipped into the washing tank 6 (shown in phantom lines). When the print is properly washed, the handle 18 is rotated counter-clockwise and pulled to align the drum with the adjacent tank 7 containing the fixing bath, and the print is dipped into this tank by rotating the handle 18 clockwise (as shown in phantom lines in FIGS. 1 and 2).

Finally, the print is removed from this last bath and the cover 2 is open: the process is ended.

Of course, various modifications and changes may be brought to the specific form of embodiment of the invention shown and described herein, as will readily occur to those conversant with the art, however without departing from the basic principles of the invention as set forth in the appended claims.

What is claimed as new is:

1. An apparatus for processing color photographic prints, which comprises:

(a) a parallelipipedic casing having a base and a light-tight cover;

(b) a tray secured to the base of said casing and formed with apertures on either side and a semi-cylindrical trough in the middle;

(c) at least four semi-cylindrical tanks provided with means permitting the snap fitting thereof in the apertures of said tray;

(d) a shaft slidably and rotatably mounted in a fixed bearing, and having its axis disposed horizontally in the median plane of the casing, and a shaft portion projecting to the outside and provided with a control handle for moving said shaft both for axial translation and rotation;

(e) a small motor and reduction-gear unit having an output shaft mounted on the inner end of said shaft and means for energizing the motor, and (f) an apertured drum detachably mounted on the output shaft of said motor and reduction gear unit.

2. An apparatus for processing color photographic prints as recited in claim 1, wherein abutment and resilient means are provided for securing said tanks to said supporting tray.

3. An apparatus for processing color photographic prints, which comprises:

(a) a parallelipipedic casing having a base and a light-tight cover having a central bulged configuration;

(b) a tray secured to the base of said casing and formed with four identical apertures disposed symmetrically on the sides and a central semi-cylindrical trough;

(c) means for heating a liquid medium filling said casing under said tray;

(d) a thermostat for controlling the temperature of said liquid medium;

(e) four semi-cylindrical detachable tanks each formed on one side with a rib adapted to engage the underface of the registering edge of the relevant aperture of said tray and on the other side with a resilient element bearing against the wall of said casing;

(f) a shaft adapted to slide and rotate freely in a fixed bearing mounted in the middle of the front wall of said casing;

(g) a handle for controlling said shaft for causing the axial translation and rotation therof;

(h) an electric motor having an output shaft associated with a reduction gear and mounted on said shaft;

(i) an aperture drum detachably mounted on the output shaft of said motor;

(j) means for retaining the photographic prints within said drum.

4. An apparatus as recited in claim 3, which comprises a programmer for indicating the time to impart to said handle a change of position.

* * * * *